US008128125B1

(12) United States Patent
Ngan

(10) Patent No.: US 8,128,125 B1
(45) **Date of Patent: *Mar. 6, 2012**

(54) MENU, PHOTO, OR CARD DISPLAY MOUNT

(76) Inventor: Chi Lung Ngan, Edison, NJ (US)

( * ) Notice: Subject to any disclaimer, the term of this patent is extended or adjusted under 35 U.S.C. 154(b) by 379 days.

This patent is subject to a terminal disclaimer.

(21) Appl. No.: 12/385,418

(22) Filed: Apr. 7, 2009

(51) Int. Cl.
*B42D 1/08* (2006.01)

(52) U.S. Cl. ..... 281/36; 40/778; 40/360; 281/15.1

(58) Field of Classification Search ..... 40/778; 281/37, 29, 36, 40, 15.1, 21.1
See application file for complete search history.

(56) References Cited

U.S. PATENT DOCUMENTS

| | | | | | |
|---|---|---|---|---|---|
| 164,249 | A | | 6/1875 | Arms | |
| 683,853 | A | | 10/1901 | Forbes | |
| 739,315 | A | | 9/1903 | Hutton | |
| 1,410,555 | A | | 3/1922 | Dexter | |
| 1,493,159 | A | | 5/1924 | Milmoe | |
| 1,840,916 | A | * | 1/1932 | Pleasants, Jr. | 281/27.2 |
| 1,988,998 | A | | 1/1935 | Cornish | |
| 1,999,423 | A | | 4/1935 | Riley | |
| 2,068,011 | A | | 1/1937 | Engel | |
| 2,085,187 | A | | 6/1937 | Engel | |
| 2,242,740 | A | * | 5/1941 | Arends | 281/36 |
| 2,359,473 | A | | 10/1944 | Fry | |
| 2,558,996 | A | | 7/1951 | Ullmann | |
| 2,825,166 | A | * | 3/1958 | Flood | 40/778 |
| 2,850,294 | A | * | 9/1958 | Curtis | 281/31 |
| 4,267,655 | A | | 5/1981 | Holson | |
| 4,659,110 | A | * | 4/1987 | Polk | 283/36 |
| 5,011,187 | A | * | 4/1991 | Hunder et al. | 281/15.1 |
| 5,066,182 | A | | 11/1991 | Stonebreaker et al. | |
| 5,135,401 | A | | 8/1992 | Feldman-Schorrig | |
| 5,323,553 | A | | 6/1994 | Candido | |
| 5,499,847 | A | * | 3/1996 | Smith | 281/37 |
| 5,499,874 | A | | 3/1996 | Tang | |
| 5,839,762 | A | | 11/1998 | Ho-Chou | |
| 6,061,943 | A | | 5/2000 | Pepys | |
| 6,138,391 | A | | 10/2000 | Ngan | |
| 6,324,777 | B1 | | 12/2001 | Ngan | |
| 6,558,099 | B2 | | 5/2003 | Mendoza et al. | |
| 6,742,809 | B2 | | 6/2004 | Frosig et al. | |
| 7,047,683 | B2 | * | 5/2006 | Austin | 40/700 |
| 7,144,044 | B2 | * | 12/2006 | Legrand | 281/15.1 |
| 7,159,347 | B1 | | 1/2007 | Ngan | |
| 7,430,824 | B1 | | 10/2008 | Ngan | |
| 7,805,872 | B1 | | 10/2010 | Ngan | |
| 7,861,441 | B1 | * | 1/2011 | Hoellwarth | 40/124.06 |
| 7,918,047 | B1 | | 4/2011 | Ngan | |
| 2002/0089167 | A1 | | 7/2002 | Peleman | |
| 2005/0120607 | A1 | * | 6/2005 | Austin | 40/773 |
| 2009/0284002 | A1 | * | 11/2009 | Miranti | 281/22 |

OTHER PUBLICATIONS

U.S. Appl. No. 12/314,414, filed Dec. 2008, Ngan.
U.S. Appl. No. 13/160,392, filed Jun. 2011, Ngan.

* cited by examiner

*Primary Examiner* — Joanne Silbermann
*Assistant Examiner* — Shin Kim
(74) *Attorney, Agent, or Firm* — Shlesinger, Arkwright & Garvey LLP

(57) ABSTRACT

A menu, photo, or card display mount includes, low profile article holder corner tabs positioned in pockets.

13 Claims, 8 Drawing Sheets

MENU, PHOTO, OR CARD DISPLAY MOUNT

FIELD OF THE INVENTION

This invention relates to a menu, photo or card or the like display mount having low profile article holder corner mounts positioned in pockets in the mount.

BACKGROUND OF THE INVENTION

Card or picture mounts and mounting tabs for pictures have been around for well over a hundred years.

Hutton U.S. Pat. No. 739,315 is an early patent showing triangular mounts in a slotted frame or mount for receiving a picture or the like.

Dexter U.S. Pat. No. 1,410,555, Riley U.S. Pat. No. 1,999,423, Milmoe U.S. Pat. No. 1,493,159 and Engel U.S. Pat. No. 2,085,187 show typical corner mounts and supports of various configurations.

OBJECTS AND SUMMARY OF THE INVENTION

It is an object of this invention to provide a menu, picture or card display mount having low profile article holder corner tabs for reducing injury to the article displayed by eliminating obstruction on the back of the tab which would normally protrude on present day tabs.

Another object of this invention is to provide a display mount with reduced thickness making albums more compact for storage purposes.

A further object of this invention is to provide a display mount in which the tabs provide a friction hold on the article to be displayed thereby reducing unintentional buckling or dislodging of the article.

A still further object of this invention is to provide a display mount with low profile article holder corner tabs which are not easily dislodged and which provide a neat and attractive appearance to the display mount.

Yet another object of this invention is to provide a display mount which can be readily assembled at a minimum of cost.

In summary, this invention provides a menu, photo or card display mount with article holder corner tabs which eliminate the hazards of dislocation by positioning the tabs in a pocket so as to maintain a low profile when the menu, photo or card or the like is inserted therein. These and other objects of the invention will be apparent from the following description and including the drawings which are as follows:

DETAILED DESCRIPTION OF THE INVENTION

FIGS. 1-12

Figure 1:
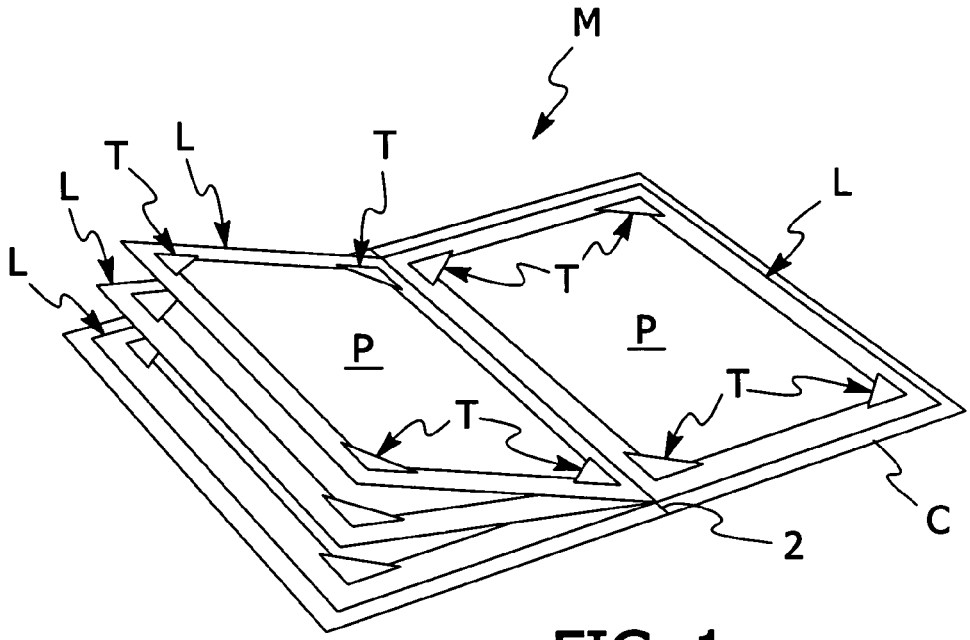
FIG. 1 shows a multipage perspective view of the invention.

FIG. 1 shows the displayed mount M shown in open position with multiple pages or leaves L. The leaves L are shown with a mounted menu, picture, or card or the like P positioned in and held by corner tabs T. A cover C to protect the menus, pictures, or cards and the like is foldable along the spine 2.

Figure 2:
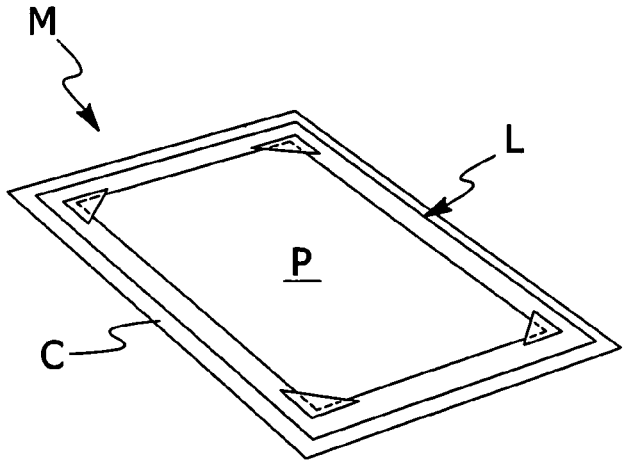
FIG. 2 is a perspective showing a top plan view of a single page of the invention.

FIG. 2 shows a single page or leaf L mounted on a cover C.

Figure 3:
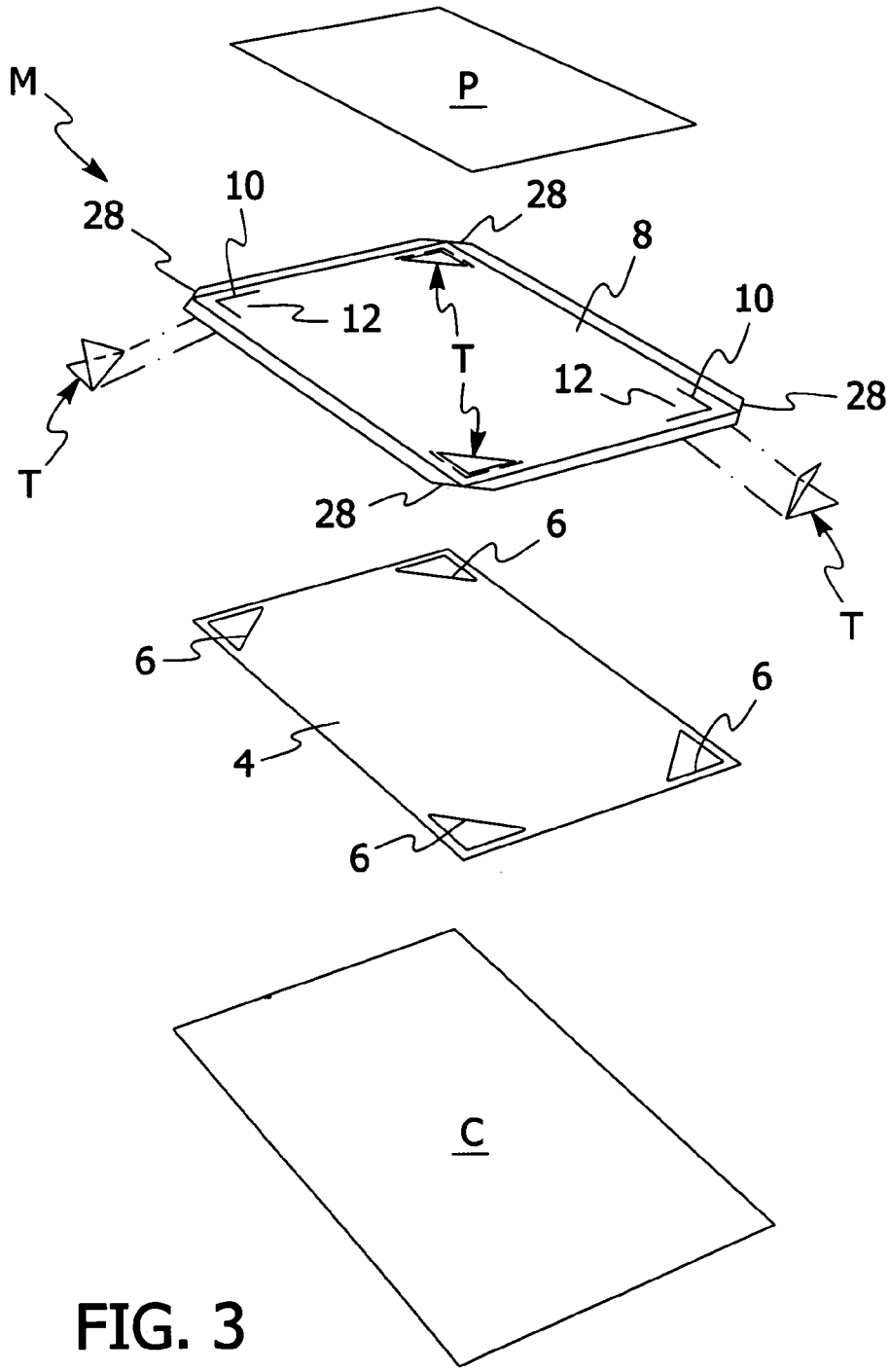
FIG. 3 is an exploded top plan view of a single page of the invention.

FIG. 3 is an exploded view of a single menu, picture or card mount M which includes a stiff support sheet 4 which may be of plastic, cardboard or the like. The support sheet 4 is provided with triangular corner pockets 6 which may be recesses or cut-outs. A flexible cover sheet 8 is provided with angular slits 10 forming tongues 12 which are positioned in and substantially lying in the triangular corner pockets 6 of the support sheet 4. Cover C in use will be fixed, glued or sealed as at G to the back of the support sheet 4. The picture, menu or card P is subsequently positioned in the corner tabs T which lie in the triangular corner pockets 6.

Figure 4:
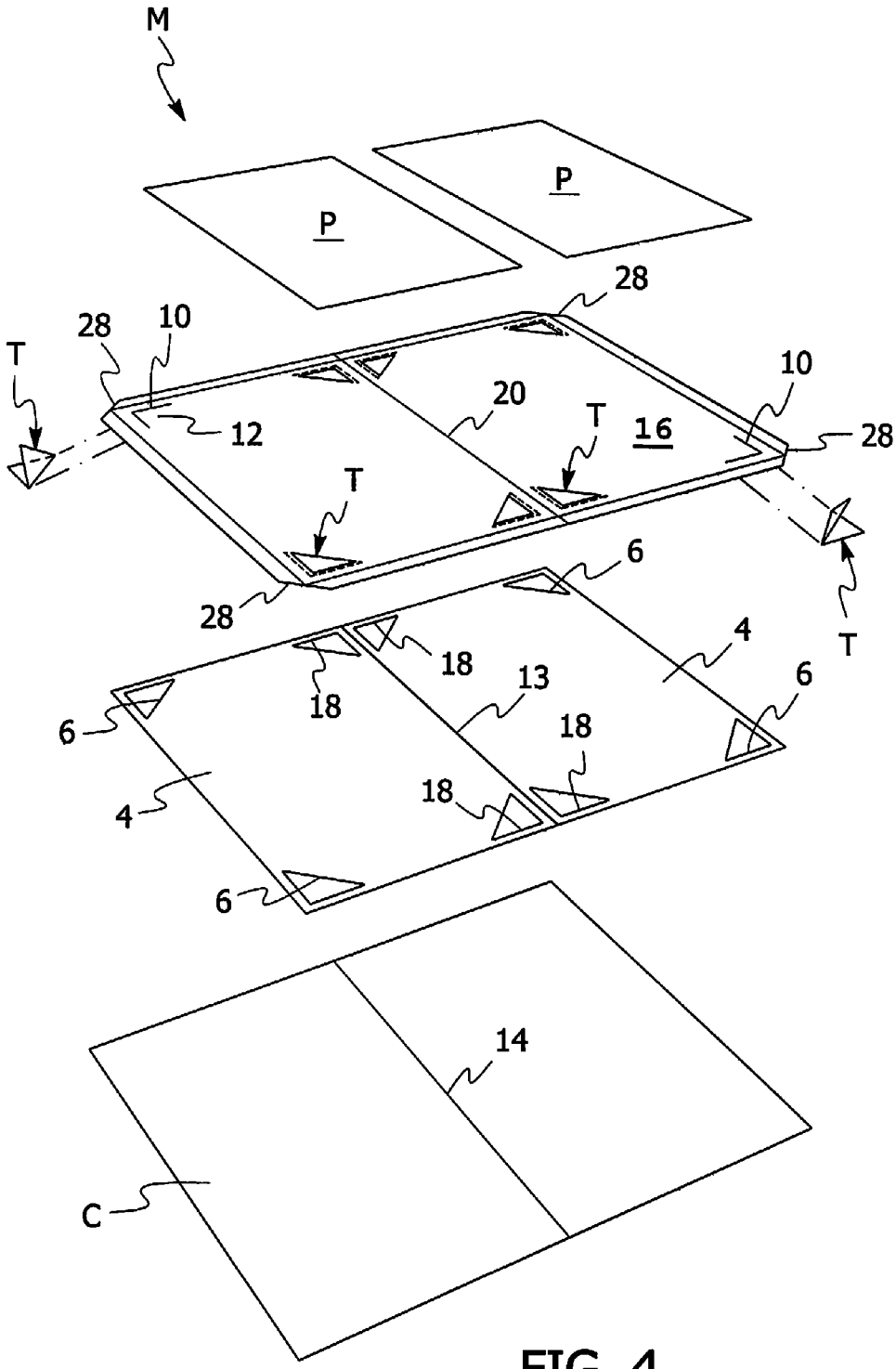
FIG. 4 is an exploded top plan view of the multipage invention.

In FIG. 4, the support sheet 4 would include a hinge 13 but may be cut in two to provide two separate and adjacent support sheets (not shown) which can be secured to the flexible single cover sheet 16. The support sheet 4 will include corner pockets 6 and intermediate pockets 18 where the support sheet 4 includes a hinge 13. Where two separate support sheets are provided, there would of course be no hinge necessary as the single cover sheet 16 would support both support sheets. The single cover sheet 16, being flexible, would fold on the hinge 20 as shown. The single cover sheet 16 has a substantial margin for folding over the edges of the support sheet 4 as subsequently described. The menus, pictures or cards P are positioned for insertion into the tabs T.

Figure 5:
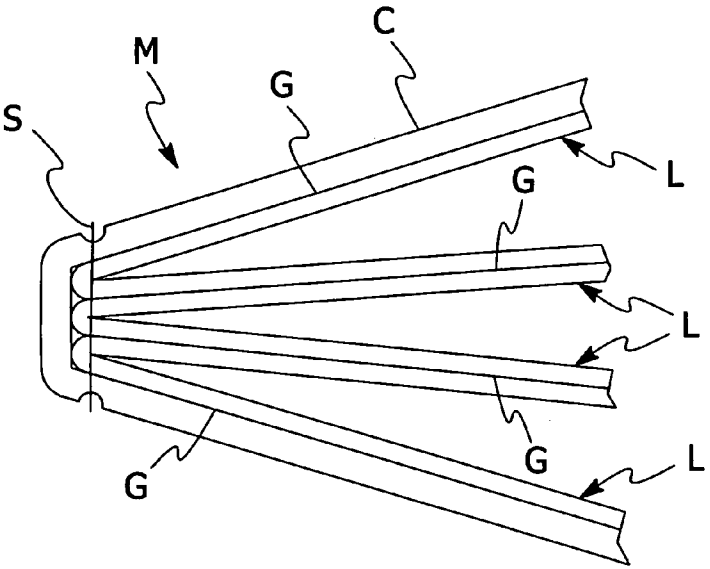
FIG. 5 is an enlarged fragmentary side elevation view showing single pages mounted in a cover.

FIG. 5 shows the cover C of the mount M supporting pages or leaves L which are individual and can be stapled or stitched as at S.

Figure 6:
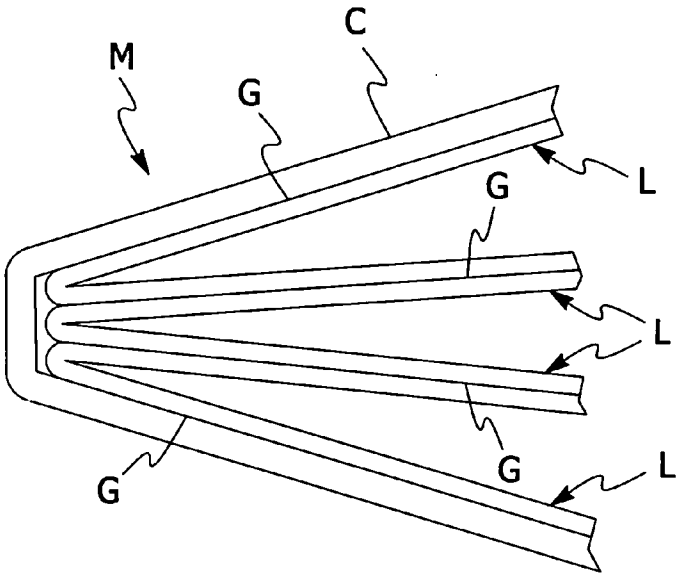
FIG. 6 is an enlarged fragmentary side elevation view of a cover supporting bi-folded pages such as illustrated in FIG. 4.

In FIG. 6, the cover C for the mount M supports the bi-fold leaves L such as would be formed in the manner shown in FIG. 4.

Figure 7:
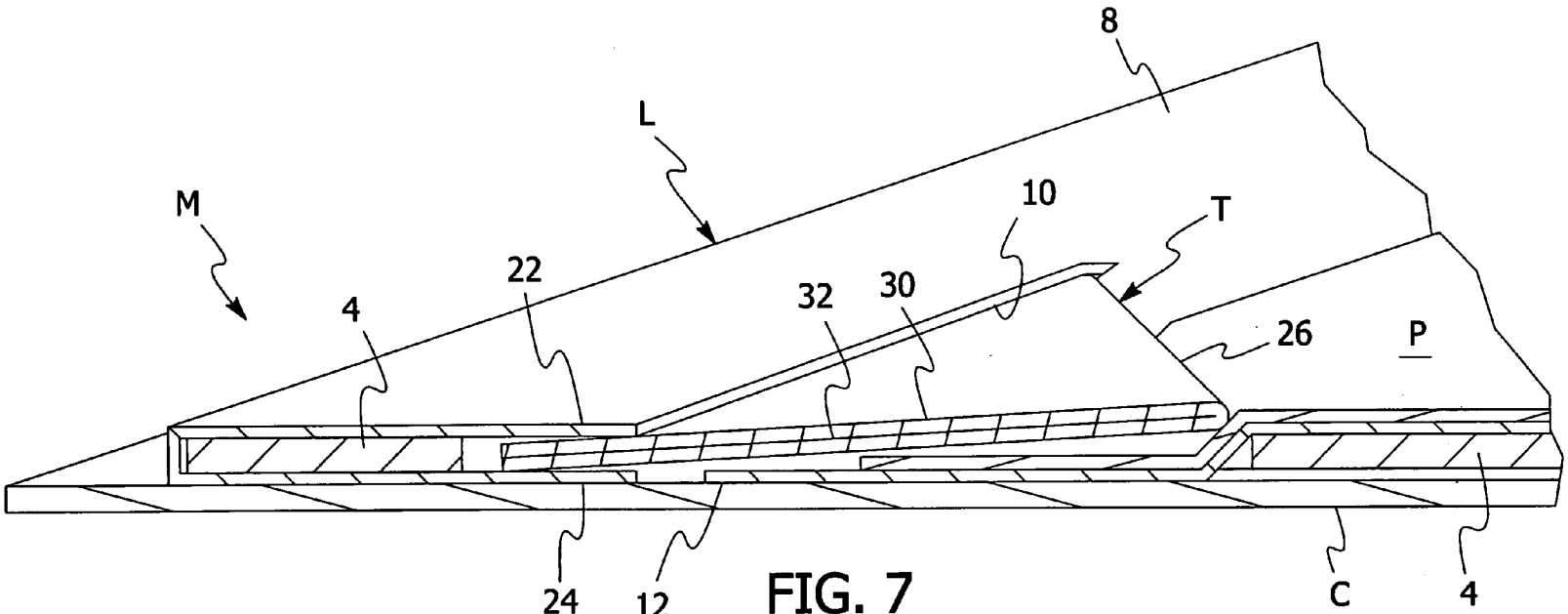
FIG. 7 is an enlarged fragmentary cross sectional top plan view taken through a corner of the invention showing a single page of the invention with backing.

FIG. 7 shows how the cover sheet 8 extends over and around the support sheet 4 at the edges 22 and 24 thereof. A tab T lies in the pocket 6 and is glued or otherwise sealed as at G to the cover sheet tongue 12 as well as to the edges 22 and 24. It should be noted that front edge 26 of the tab T central portion is free and not glued or sealed but only the side edges to permit insertion of the menu, photo or card P. The front edge 26 of the tab T projects slightly above the flexible cover sheet 8.

Figure 8:
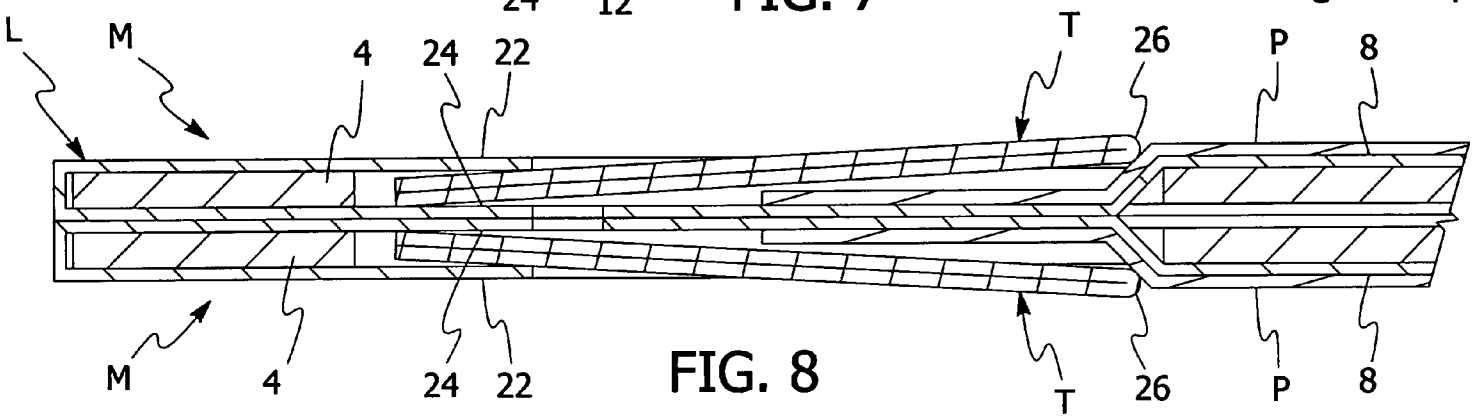
FIG. 8 is an enlarged cross sectional end view taken through a corner of the invention and showing a back to back positioning of the invention as shown in FIG. 4 when folded and sealed.

In FIG. 8, the cover C is removed and two of the mounts M illustrated in FIG. 7 are positioned in back to back arrangement so that menus, pictures, cards or the like would be on either side of a leaf L.

Figure 9:
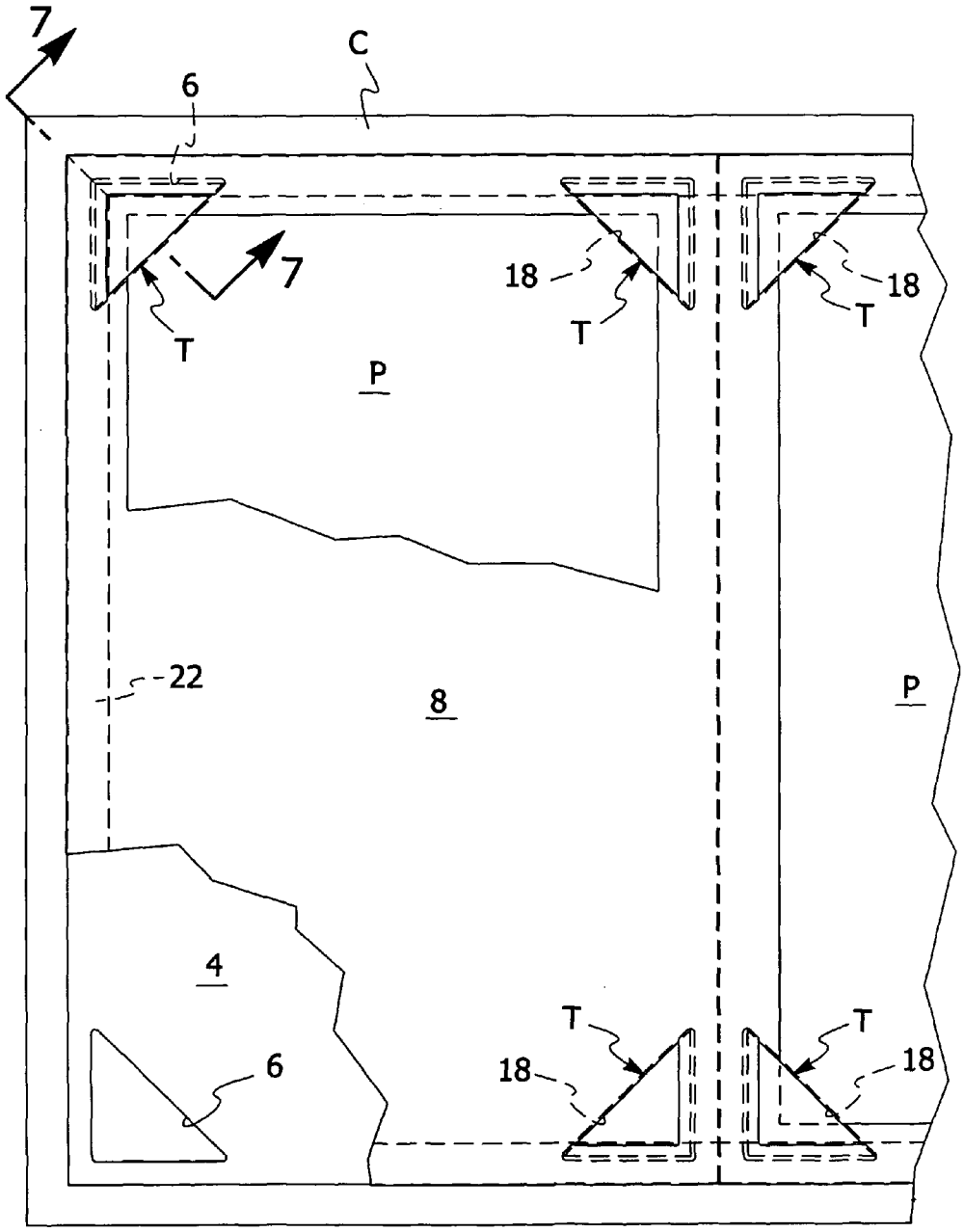
FIG. 9 is a fragmentary top plan view of the invention showing portions broken away and in phantom lines.
Figure 10:
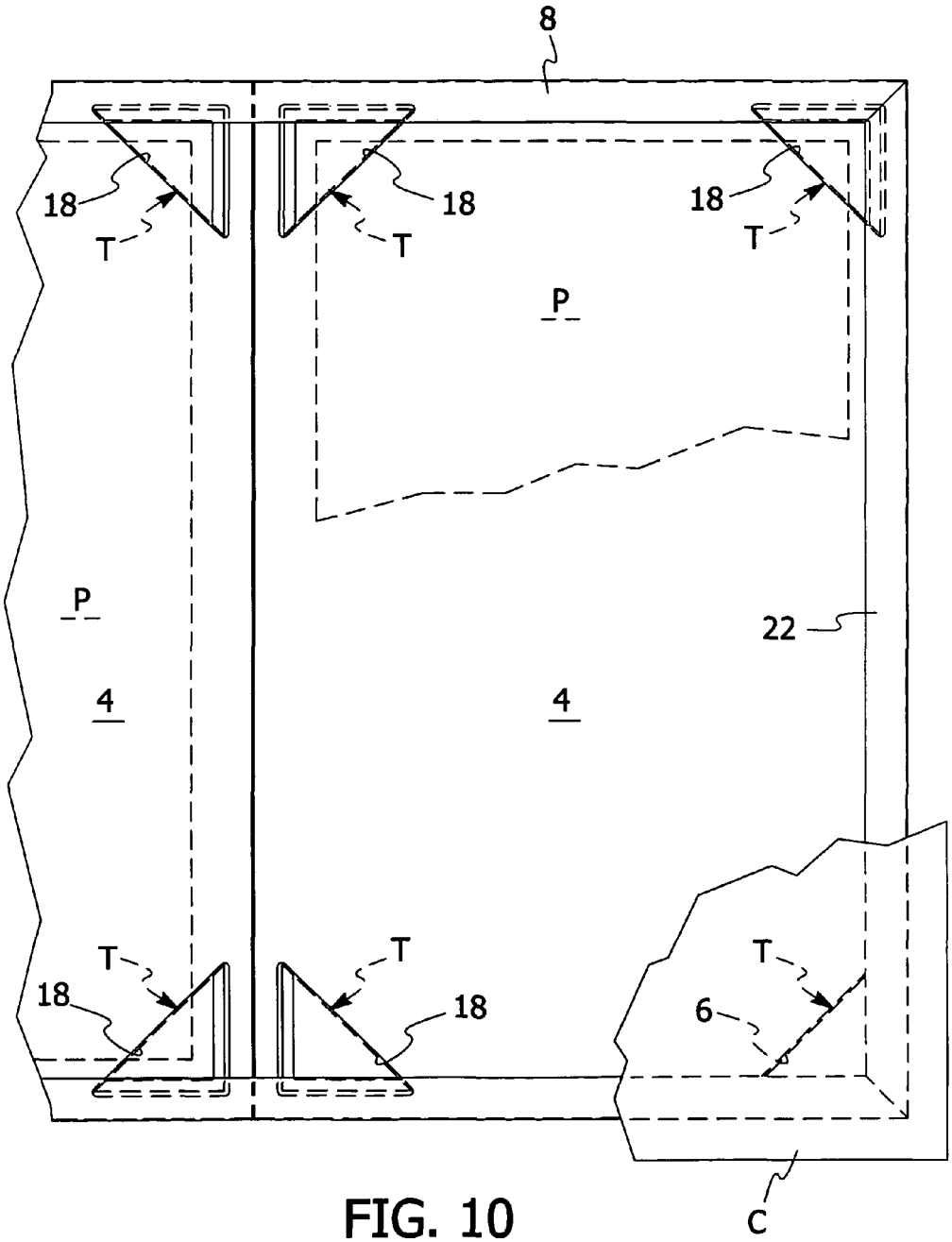
FIG. 10 is a fragmentary bottom plan view of the invention showing portions broken away and in phantom lines.

FIGS. 9 and 10 respectively show bottom and top plan views illustrating how the edges of 23 and 24 of the top sheet 8 extend over and is affixed to the sides of the triangular tab T to secure it in position. Central portion of the base of the tab T is not fixed to permit the edge of the menu, photo or card P to be inserted therein.

Figure 11:
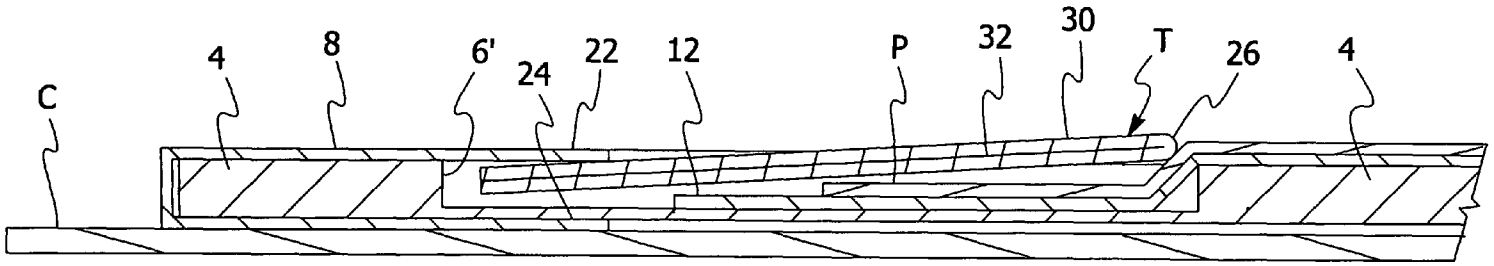
FIG. 11 is a modification of the invention showing an enlarged fragmentary cross sectional view through one end of a single page of the invention with backing.
Figure 12:
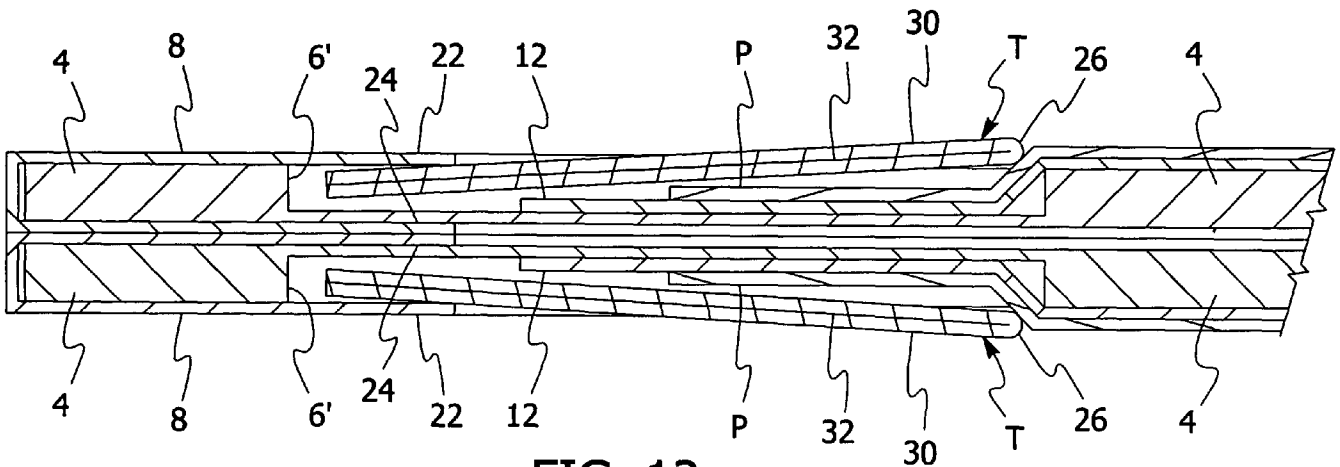
FIG. 12 is a modification of the invention of FIG. 11 showing a back-to-back enlarged fragmentary cross sectional view.

FIGS. 11 and 12 show how the pocket 6 is a recess and not a through cut-out as shown in FIGS. 7 and 8. FIG. 11 shows a single leaf L mounted to the cover C whereas FIG. 12 shows a back-to-back mounting of two leaves L.

It should be noted that the flexible cover sheets 8 include chamfered corners 28 to afford a smooth surface where the edges come together. It also should be noted that the corner tabs T for strength and wear purposes are multi-layered as at 30 and 32 as best shown in FIGS. 7, 8, 11 and 12.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. A menu, photo, or card display mount having low profile article holder corner tabs comprising:

a) a stiff support sheet having a front and back and having corner and marginal edges;

b) a flexible cover sheet for said support sheet having marginal edges and corners extending over and around said support sheet's marginal edges and corners;

c) said support sheet having corner position triangular planar pockets;

d) said cover sheet having angular slits forming tongues positioned in and substantially lying in the plane of said corner position triangular planar pockets;

e) said low profile corner tabs being triangular and each having sides and a base substantially filling its respective planar pockets and lying on its respective cover sheet tongue in said respective triangular planar pocket;

f) said cover sheet marginal edges extending and connected to and covering said side edges only of said low profile corner tabs; and g) said front edge of said triangular corner tabs having a substantial central portion unattached to said cover sheet and secured to said cover sheet only at said base ends for insertion of said menu, photo or card in said display mount.

2. A menu, photo, or card display mount as in claim 1 and wherein:

a) a pair of display mounts are inter-connected.

3. A menu, photo, or card display mount as in claim 2 and wherein:

a) said pair of said display mounts include a single cover sheet connecting said pair of display mounts.

4. A menu, photo, or card display mount as in claim 1 and wherein:

a) said cover sheet has chamfered cornered edges.

5. A menu, photo, or card display mount as in claim 1 and wherein:

a) said mount includes a back cover connected to and engaging and covering said support sheet back.

6. A menu, photo, or card display mount as in claim 1 and wherein:

a) said low profile corner tabs are multiply.

7. A menu, photo, or card display mount as in claim 1 and wherein:

a) said flexible cover sheet is bonded overall to said stiff support sheet.

8. A menu, photo, or card display mount as in claim 2 and wherein:

a) said inter-connected display mounts are positionable together in leaf fashion.

9. A menu, photo, or card display mount as in claim 2 and wherein:

a) said inter-connected display mounts are connected back-to-back.

10. A menu, photo, or card display mount as in claim 2 and wherein:

a) a plurality of inter-connected display mounts are positioned together in book-leaf fashion; and b) including a flexible back cover supporting said plurality of inter-connected display mounts.

11. A menu, photo, or card display mount as in claim 1 and wherein:

a) said planar pockets are cut-outs.

12. A menu, photo, or card display mount as in claim 1 and wherein:

a) said planar pockets are recesses.

13. A menu, photo, or card display mount as in claim 1 and wherein:

a) said corner tabs have a front and back, and b) said corner tabs' back is covered by said cover sheet.

* * * * *